United States Patent [19]

Seely et al.

[11] Patent Number: 4,519,152

[45] Date of Patent: May 28, 1985

[54] TAMPER PROOF POSTER DISPLAY DEVICE

[75] Inventors: James R. Seely, Rochester; Robert Sarkisian, Bloomfield Hills, both of Mich.

[73] Assignee: Marketing Displays, Inc., Farmington Hills, Mich.

[21] Appl. No.: 521,413

[22] Filed: Aug. 8, 1983

[51] Int. Cl.[3] ..... G09F 1/12

[52] U.S. Cl. ..... 40/156; 40/13; 40/152

[58] Field of Search ..... 40/156, 13, 152, 624

[56] References Cited

U.S. PATENT DOCUMENTS

| | | | |
|---|---|---|---|
| 3,310,901 | 6/1965 | Sarkisian | 40/13 |
| 3,987,567 | 10/1976 | Fritts | 40/624 |
| 4,169,327 | 10/1979 | Stilling | 40/549 |

FOREIGN PATENT DOCUMENTS

| | | |
|---|---|---|
| 868268 | 5/1961 | United Kingdom . |
| 2010673A | 7/1979 | United Kingdom . |
| 2021945A | 12/1979 | United Kingdom . |

*Primary Examiner*—Robert P. Swiatek
*Assistant Examiner*—Cary E. Stone
*Attorney, Agent, or Firm*—Harness, Dickey & Pierce

[57] ABSTRACT

A theft proof poster display device having front and back extruded portions pivotally connected to one another to define a frame forming member. The front portion defines a generally u-shaped member having smooth surfaces and rounded non-convoluted corners and the front and back portions are biased together under spring compression rendering a poster frame which cannot be gripped with enough frictional force to open the frame. An opener tool with lever arm and an integral inclined planar wedge member is engageable with the front portion of the frame for opening the poster display device.

29 Claims, 9 Drawing Figures

TAMPER PROOF POSTER DISPLAY DEVICE

BACKGROUND OF THE INVENTION

1. Field of the Invention

The present invention relates generally to poster frames and display holders for various types of replaceable posters, pictures and similar advertising materials. More specifically, the invention pertains to an anti-theft or tamper-proof poster display device which can be used in many various areas, such as on buses, taxi cabs, and similar mobile installations, as well as on fixed mounts such as on posts or walls in service stations, subway terminals, movie theaters or the like. The poster display device is neat, trim, aesthetic, and capable of being used either indoors or outdoors. It is particularly useful in applications where theft of the poster, picture or advertising material could be a problem.

2. Description of the Prior Art

Tamper proof poster display devices of the prior art have typically been constructed in the form of a locked box containing the poster, having a window through which the poster could be viewed. Such devices are typically expensive and require key operated locks. Many of such glass boxes also need internal fluorescent lighting since the box construction could cast shadows on the poster. These prior art poster display devices are also cumbersome and unattractive, and expensive to repair or replace.

In contrast to the cumbersome window box or showcase style poster display device, a variety of more streamlined and economical spring loaded poster display devices have been developed by the assignee of the present invention. However, until the present invention, the spring loaded poster display devices have been operable and changeable by hand and have not been entirely tamper-proof.

As well as being an improvement over the window box or show case style devices, the present invention is an improvement over the invention disclosed and claimed in U.S. Pat. No. 4,145,828 and assigned to the assignee of the present invention. In that patent a display holder is set forth having a plurality of frame sections. Each of the sections is made essentially of two extruded portions which are pivoted together, the extruded portions being of any material which can be economically extruded, such as aluminum. Extruded frame sections are biased by means of an unbent metal leaf spring which coacts with the two extruded portions to releaseably clamp posters or similar display items in the frame. The invention as disclosed and claimed in U.S. Pat. No. 4,145,828 was itself an improvement over U.S. Pat. No. 3,310,901 which employed cantilever action-type metal leaf springs with S-shaped hooks at one end to bias together the two parts of the frame.

The present invention is also an improvement over the inventions disclosed in the following patent applications: Ser. No. 424,883, filed Sept. 27, 1982, entitled "Spring Loaded Poster Frame"; Ser. No. 448,047, filed Dec. 8, 1982, entitled "Spring Loaded Poster Frame"; and Ser. No. 499,441, filed June 6, 1983, entitled "Improved Spring Loaded Poster Frame". Each of the foregoing patent applications are assigned to the assignee of the present invention. Generally the inventions disclosed and claimed in these applications relate to plastic poster frame and display holders including a relatively resilient elongated plastic portion which is integrally formed as part of the poster frame sections for providing biasing forces or clamping forces for holding the poster or display material between hingedly connected extruded frame forming sections.

While each of the aforesaid inventions has proven generally suitable, none are completely tamper-proof. Generally speaking, each of the display holders includes means attached to or formed on the outwardly facing extruded portion for grasping in manipulation to open or close the outwardly facing portion relative to the other extruded portion. Typically such grasping means takes the form of a formed side panel or flange having a ridge thereon or otherwise defining a longitudinal recess which can be grasped in manipulation to open or close the frame. Each of these poster frame devices can be readily opened and hence can be tampered with by vandals or by simply curious bypassers. Since often times posters, pictures, or advertising material must be displayed in places such as movie theaters, subway terminals, bus terminals, or airport terminals where idle, unsupervised crowds will congregate, there is a great need for an economical and aesthetically pleasing tamper-proof poster frame.

SUMMARY OF THE INVENTION

The present invention provides a reliable and aesthetically pleasing display holder and poster frame which is effectively tamper-proof. The tamper-proof poster display device of the present invention comprises front and back portions adapted to be assembled in pivotal relationship to one another, defining a polygonal frame structure to receive a display piece, poster or the like. The front and back portions are provided with coacting hinge formations, integral respectively therewith, which mate in pivotal engagement with one another. A spring means, either metal leaf spring or extruded plastic spring, extends between the front and back portions to bias the front portion with a snap-over action between its closed position in clamping engagement with the display piece and its open position for removeably receiving the display piece. The front portion of the display device has an outwardly presenting first surface and a laterally presenting second surface. The first and second surfaces smoothly and continously converge to define an included dihedral angle greater than 90°. A laterally presenting third surface is smoothly and continuously convergent with the first surface such that the first, second and third surfaces join to define a generally U-shaped member wherein the average plane of the second and third surfaces converge along a locus disposed outwardly of said first surface. The surfaces of the frame are smooth, defining a rounded or sloping U-shaped contour with nonconvoluted corners which renders the frame impossible to grip with enough gripping force or frictional force to open the frame against the spring bias tension. An opener tool is provided which has a fulcrum end portion for engaging the U-shaped members, a handle, and an inclined planar portion for insertion between the display piece and the front portion. The display holder may thus be opened by placing the fulcrum end portion over the U-shaped member and rocking upwardly on the handle.

DESCRIPTION OF THE PREFERRED EMBODIMENTS

Figure 1:
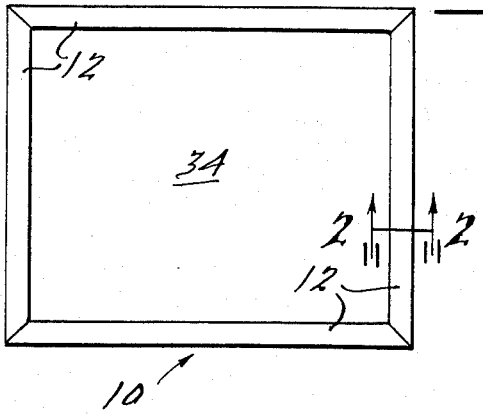
FIG. 1 is a front view of a tamper-proof display holder in accordance with the invention.
Figure 2:
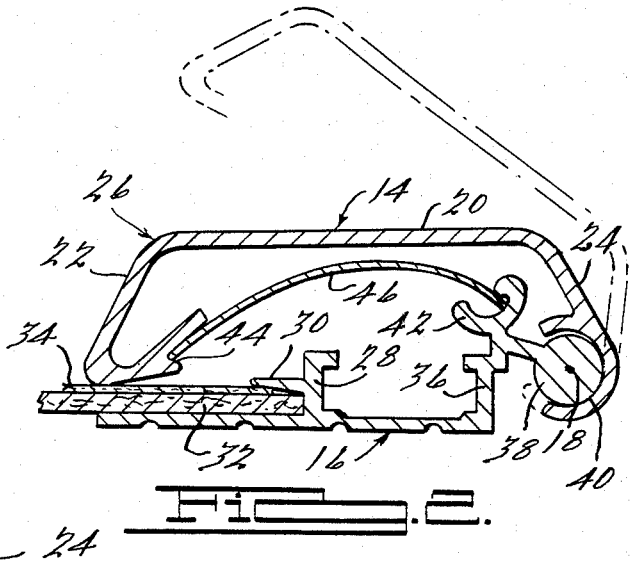
FIG. 2 is a cross-sectional view taken along the line 2—2 in FIG. 1.

As illustrated in FIG. 1, the tamper-proof display holder of the invention, generally designated by the reference numeral 10 is made up of a plurality of frame sections 12. For a square or rectangular shaped poster, four frame sections 12 are normally provided. The frame sections are mitered at 45° at their ends and fastened together to form a box type frame. A backing member of hardboard, fiberboard, or metal is provided and the frame is secured on or around its edges forming the complete poster framing device. As shown in FIG. 2, end of the sections 12 is generally constituted of a front portion 14 and a back portion 16 which are pivoted together as at 17 for relative rotational movement about pivot axis 18. Portion 14 includes outwardly facing surface 20 and first and second generally laterally facing surfaces 22 and 24 which smoothly and continuously join with outwardly facing surface 20 to define a generally U-shaped surface 26 which will be described more fully below.

Portion 16 includes upstanding flange 28 having channel forming lip 30 for receiving backing member 32 and for receiving and aligning the display piece or poster 34. Portion 16 further includes a second upstanding flange 36 having outwardly projecting pintle formation 38. Pintle formation 38 mates with a complementary cup-shaped formation 40 disposed on portion 14 adjacent laterally facing surface 24 to define coacting hinge 17. Upstanding flange 36 further includes arcuate spring receiving channel forming structure 42. Likewise, portion 14 is also provided with spring receiving structure 44 disposed generally adjacent surface 22. Leaf spring 46 carried in structures 42 and 44 extends between the front and back portions to bias the front portion with a snap-over action between a closed position in clamping engagement with display piece 34 and an open position, shown in FIG. 8, for removably receiving the display piece. Further details with respect to the foregoing frame construction may be found in U.S. Pat. Nos. 4,145,828 and 3,310,901, which are hereby incorporated by reference.

Figure 3:
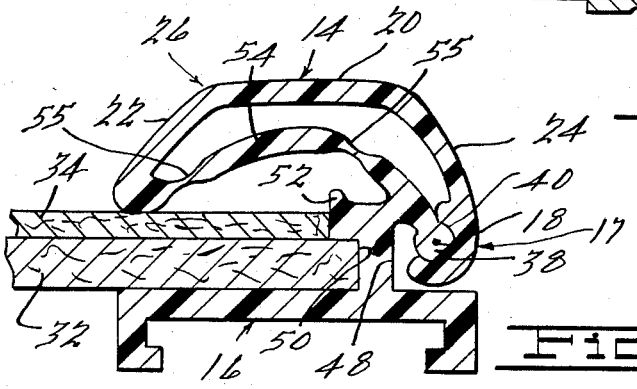
FIG. 3 is a cross-sectional view of another embodiment of the invention.

An alternative embodiment is illustrated in FIG. 3 wherein front portion 14 and back portion 16 are formed of a common extrusion as taught in U.S. patent application Ser. No. 424,883, filed Sept. 27, 1982 entitled "Spring Loaded Poster Frame"; Ser. No. 448,047, filed Dec. 8, 1982 entitled "Spring Loaded Poster Frame"; and Ser. No. 499,441, filed June 6, 1983 entitled "Improved Spring Loaded Poster Frame". Each of the foregoing patent applications are assigned to the assignee of the present invention and are incorporated herein by reference. As shown in FIG. 3 portion 14 includes outwardly facing surface 20 and laterally facing surfaces 22 and 24 which join with surface 20 in a smooth, non-convoluted non-reentrant contour to define a generally U-shaped member 26. Portion 16 includes upstanding flange 48 having outwardly projecting pintle formation 38 integrally formed thereon. Upstanding flange 48 also defines channel 50 for receiving backing member 32, and includes ear 52 which serves to receive and align display piece 34.

The front and back portions 14 and 16 are pivotally joined as at hinge assembly 17 for relative rotation about hinge axis 18. The hinge assembly is comprised of pivot pintle formation 38 and complementary cup-shaped formation 40 disposed on portion 14 adjacent surface 24. Portions 14 and 16 are further joined by spring means 54 extending between front portion 14 and back portion 16 to bias the former with a snap-over action between a closed position in clamping engagement with display piece 34 and an open position to removably receive the display piece. More specifically, spring means 54 comprises an elongated relative resilient, flexible biasing portion formed as part of the extrusion common to portions 14 and 16. For example, portion 14 and 16 may be of a plastic material such as polypropylene vinyl, or rigid polyvinyl chloride. The elongated biasing portion which constitutes spring means 54 may be of a relatively resilient material such as estane polyurethane, or of a softer vinyl material having living hinges 55 to facilitate the snap over action.

Figure 4:
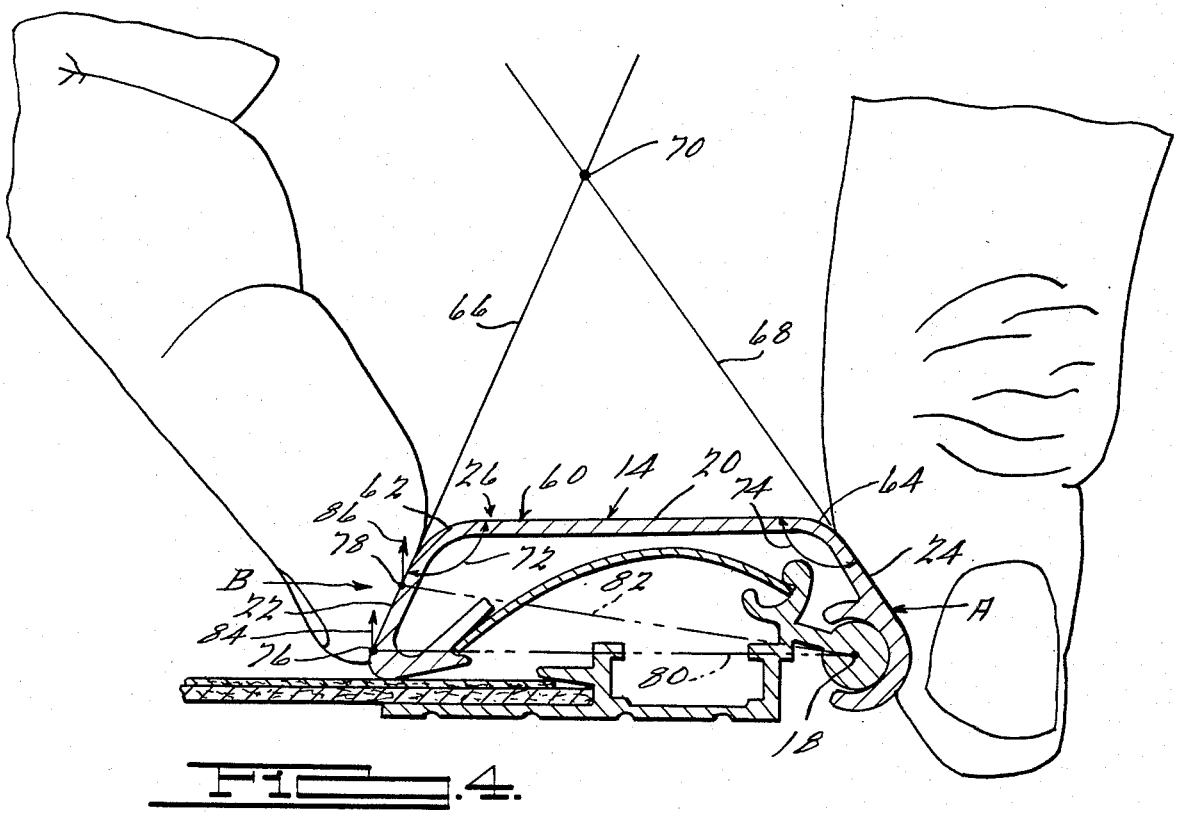
FIG. 4 is a cross-sectional view of the invention illustrating its tamper-proof characteristics.

With reference to FIG. 4, U-shaped member 26 will be described in further detail. In order to more fully illustrate the tamper-proof attributes of the invention, FIG. 4 depicts the fingers and thumb of a person's hand as they might be placed when attempting to manually grip and pivot front portion 14 about axis 18 towards the open position of the frame. While the illustrated placement of fingers and thumb is believed to be typical of most persons attempts at gripping the frame, the invention is equally tamper-proof against other gripping positions or against prying as with fingernails or car keys for example. U-shaped member 26 has a contoured non-reentrant outer surface 60 comprised of outwardly facing surface 20 and laterally facing surfaces 22 and 24. Surfaces 22 and 24 meet or join with surface 20 in a smooth continuous fashion forming rounded, non-convoluted corners 62 and 64 respectively. Surfaces 22 and 24 lie in average planes, denoted by lines 66 and 68, which converge along a locus, denoted by point 70, which is disposed outwardly of surface 20. "Outwardly disposed" is understood to mean gradually in the direction surfaces 20 is facing. Surfaces 20 and 22 converge to define an included dihedral angle greater than 90° as illustrated by reference numeral 72. Similarly, surfaces 20 and 24 converge to define an included dihedral angle greater than 90°, as illustrated by reference numeral 74. In order to open the poster frame, front portion 14 must be rotated with respect to back portion 16 about the hinge axis 18. In so rotating, each point on surface 60 follows a circular trajectory about axis 18. Two such points have been designated in FIG. 4 as points 76 and 78. The radius of rotation of point 76 is illustrated by the line 80, and the radius of rotation of point 78 is illustrated by line 82. Vectors 84 and 86 indicate the direction in which points 76 and 78 will move at the instant rotation of portion 14 is commenced. Such direction vectors are perpendicular to the corresponding radius of rotation, and hence tangent to the circular trajectory of the point under consideration. While points 76 and 78 have been selected for purposes of illustration, it will be understood that the above holds true for all points on the surface 60.

Figure 5:
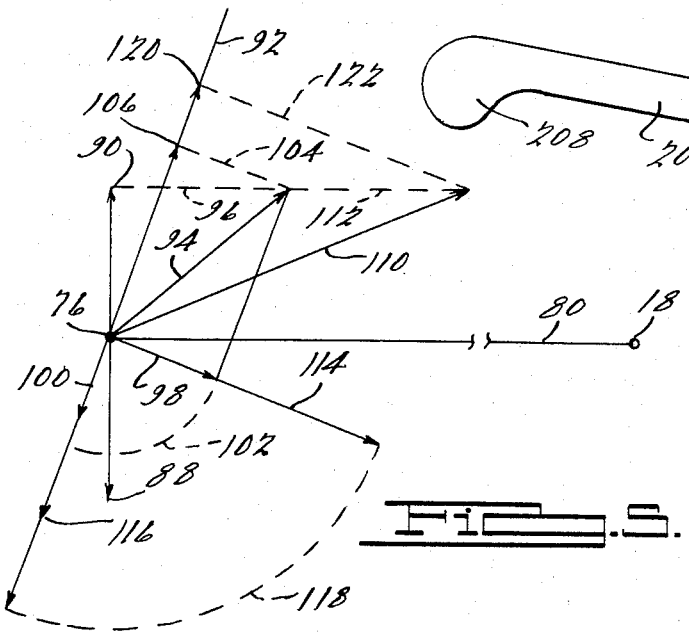
FIG. 5 is a schematic free body force diagram further illustrating the principles of the invention.

Focusing attention on point 76, for the moment, FIG. 5 is a schematic free body diagram illustrating the interplay of various forces which affect the operation of the invention. With specific reference to FIG. 5, vector 88 is used to denote the spring force or bias force delivered by spring 46. It is noted that vector 88 is perpendicular to line 80 representing the radius of rotation of point 76. It will be understood that the length or magnitude of vector 88 has been arbitrarily selected for illustration purposes only. Vector 90 is the mirror image of vector 88, representing the amount of directly offsetting force needed to overcome the bias force. Line 92 is included in FIG. 5 to schematically denote the average plane of surface 22. In attempting to manually grip and open the poster display device, one might apply a force to point 76 which can be vectorally resolved into a gripping force component and a lifting force component. For example, were a person to apply a force at point 76 in a direction parallel to line 92, said force would comprise a lifting component but no gripping component. It will be appreciated that a gripping force component would require the application of forces perpendicular to the surface being gripped in order to produce frictional forces at the surface. Alternatively, a person might at point 76 apply a force parallel to radius of rotation line 80, in which case said force would comprise a gripping component but no lifting component. The foregoing two cases represent two extremes. In most cases, a person attempting to open the poster display device would probably apply a force at point 76 in any arbitrary direction between these two extremes. For purposes of further illustration two such arbitrary selections will be analyzed.

It will first be assumed that a force denoted by vector 94 is applied at point 76. As shown by dotted resolution line 96, vector 94 includes a lifting component in a direction parallel to vector 90. For purposes of this example it is assumed that this lifting component is equal in magnitude to vector 90, since vector 90 represents the amount of force needed to just overcome the spring tension of the poster frame. In actuality, however, this lifting component would need to be incrementally greater than the magnitude of vector 90 in order to hingedly open the poster frame. Force vector 94 also includes a component normal to the surface 22, i.e. perpendicular to line 92. This normal component is denoted by vector 98. The amount of gripping force or frictional force developed at point 76 is directly proportional to the magnitude of normal component vector 98. According to the formula $F_f = uN$, where $F_f$ denotes the magnitude of the frictional force, u denotes the coefficient of friction between surface 22 and the persons finger for example, and N denotes the normal force vector 98. This frictional force is a vector directed along line 92 in a direction opposing slippage between the persons finger and the surface 22. Assuming the coefficient of friction to be fractionally less than unity, the frictional force appears as vector 100. In FIG. 5, vector 100 has been constructed by rotating vector 98 about arc 102 and then reducing the magnitude of the constructed vector to reflect the affect of the coefficient of friction. Directing one's attention again to the applied force vector 94, it will be seen with the aid of reference line 104 that applied force vector 94 has a component 106 running along line 92 in a direction directly opposite to frictional force 100. Upon comparison it is readily detected that vector 106 is greater in magnitude than vector 100. As a consequence thereof the persons finger will slip when force 94 is applied.

For purposes of further illustration a second arbitrary force application will now be considered. For this second example it will be assumed that a force denoted by vector 110 is applied at point 76. As shown by dotted resolution line 112, vector 110 includes a lifting component in a direction parallel to vector 90 and also includes a normal component 114 perpendicular to the surface 22, i.e. perpendicular to line 92. Note by comparing vector 110 with vector 94 that the applied force in this second example is considerably greater in magnitude than the applied force in the previous example. Following the analysis used in the previous example, the frictional force produced along line 92 is indicated by vector 116. As in the previous analysis, vector 116 is constructed by rotating vector 114 about arc 118 and then reducing the magnitude of the constructed vector to reflect the effect of coefficient of friction. The applied force vector 110 has a component 120 running along line 92 in a direction directly opposite to frictional force 116, as will be seen with the aid of reference line 122. Again a comparison of the magnitude of vector 120 with the magnitude of vector 116 indicates that the frictional force 116 resisting slippage is less than the component of the lifting force tending to produce slippage. As a consequence thereof, the person's finger or other force applying means will slip when force 110 is applied.

From the foregoing it will be understood that the poster display device of the invention derives anti-theft advantages from several factors. As will be explained more fully below, the surface coefficient of friction and the angular relationship among surfaces 20, 22 and 24 greatly affects the tendency for one's fingers to slip during attempts to grasp and open the poster display device. In addition, the spring bias force delivered by spring means 54 also affects the poster display device's anti-theft characteristics. Spring bias force is particularly important, for example, in resisting attempts to open the device by prying under edge 63 in order to apply lifting forces under clamping surface 65, as with fingernails, car keys, etc. In the presently preferred embodiment, the surface coefficient of friction and angular relationship among surfaces 20, 22 and 24 are selected so that it is not possible to manually grip and open the poster display device even if spring means 54 is totally eliminated. For an extruded anodized aluminum poster display device, for which the coefficient of friction between surfaces 20, 22 and 24 and the fingertips is nominally 0.38, it has been found that the angles indicated in FIG. 2 are quite effective. In general, however, the poster display device may be constructed using materials having different coefficients of friction and having surfaces of different angular relationships without departing from the spirit of the invention or the scope of the following claims. The following will describe the inter-relationship between the surface coefficient of friction and the angular relationships to enable one skilled in the art to practice the invention using different materials and/or angular relationship.

Figure 9:
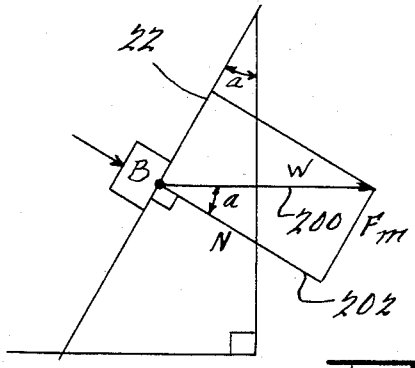
FIG. 9 is a schematic diagram illustrating the interplay between surface friction and the angular relationship of the planar surfaces of the invention.

Referring now to FIGS. 4 and 9, the poster display device of the present invention is illustrated with gripping forces being schematically applied at points A and B in FIG. 4. FIG. 9 is a magnified schematic view showing surface 22 in greater detail. Gripping force is applied at point B as denoted by vector 200. Gripping force vector 200 is applied at an angle "a" with respect to the normal of surface 22. The normal to surface 22 is depicted by line 202 in FIG. 9. Assume for the moment that a gripping force W is applied at point B in the direction of vector 200, and that force W is just on the point of slipping along surface 22. Hence the frictional force at point B is at a maximum, designated by $F_m$. The component of force W down the plane 22 is "W sin a" and the normal to the plane is "W cos a". Hence the ratio Fm/N is as follows:

$$\frac{Fm}{N} = \frac{W\sin a}{W\cos a} = \tan a$$

But the ratio $F_m/N$ is the coefficient of friction "u". That is, $F_m/N=u$. Thus it follows that at the verge of slipping: $\tan^{-1}[u]=a$. Stated somewhat differently, in order for slipping to occur, angle "a" (the angle of the applied gripping force with respect to the surface normal) must be greater than or equal to the arctangent of the surface coefficient of friction "u". The surface normal is by definition a line perpendicular to a line tangent to the surface. This may be stated in terms of the following equation: $a=\tan^{-1}[u]$. Using the above equation and substituting the coefficient of friction for fingertips on anodized aluminum (0.38) in place of "u", we can calculate that angle "a" must be greater than or equal to 20.8 degrees in order for slipping to occur regardless of the spring bias tension applied. Recall that angle "a" is the angle at which the gripping force is applied, measured with respect to the surface normal. By angling surface 22 with respect to surface 20 so that the most advantageous gripping angle is not less than angle "a", (the same holds true for the angle between surfaces 20 and 24) then the poster display device is assured to be impossible to grip with enough force to open it.

Figure 6:
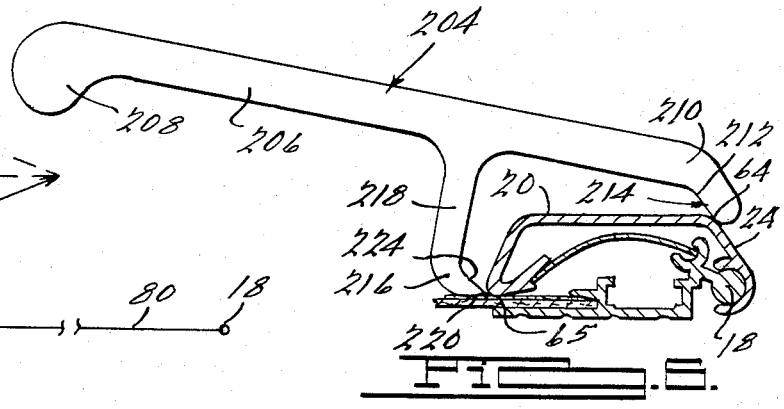
FIGS. 6 through 8 are cross-sectional views illustrating the frame being opened using an opening tool.
Figure 7:
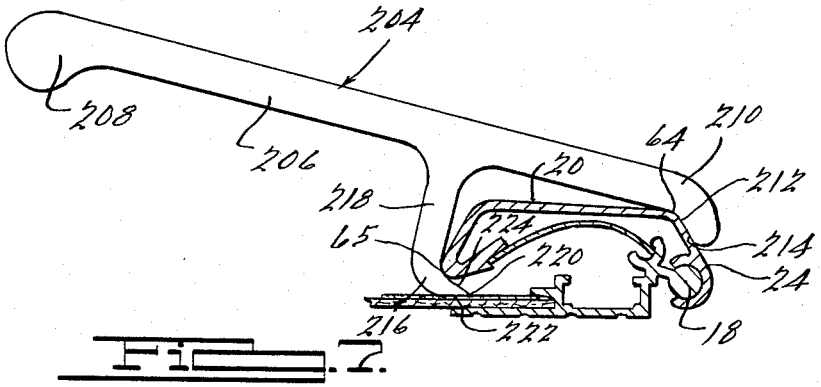
Figure 8:
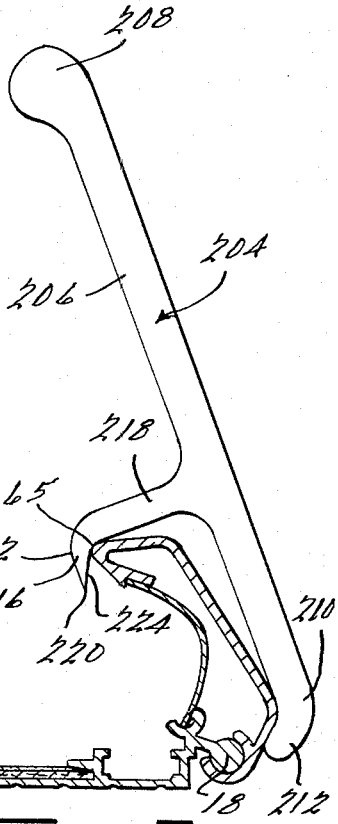

Indeed some method must be provided for opening the poster display device in order to remove or replace posters displayed therein, and accordingly a specially designed opener tool is provided. The opener tool and its use is illustrated in FIGS. 6 through 8. Opener tool 204 comprises a lever arm 206 having a handle portion 208 at one end thereof and a fulcrum portion 210 at the opposite end thereof. Fulcrum portion 210 includes a downturned lip 212 having an inner surface or undersurface 214 adapted for mating engagement with corner 64 and also with portions of surfaces 20 and 24, as seen in FIG. 7. Opener tool 204 further includes an inclined planar portion 216 carried on lever arm 206 by flange 218 and terminating in a substantially sharp chisel edge 220. Flange 218 is disposed on an intermediate portion of the lever arm 206 between handle 208 and fulcrum 210. The inclined planar portion 216 includes a substantially flat undersurface 222 which, in use, rests against the surface of the poster, display piece, or protective plastic or glass layer without gouging or puncturing the same. The inclined planar portion includes an inclined planar upper surface 224 which, in use, is used as a wedge to open the frame.

FIGS. 6, 7 and 8 depict the opening sequence which may be further described as follows. Tool 204 is placed against the poster display device and display piece with lip 212 resting on corner 64 and underside surface 222 resting on the display piece, as shown in FIG. 6. It will be seen that chisel edge 220 and undersurface 214 are disposed in spaced relation a distance less than the distance between corner 64 and edge 65. Next the lever arm 206 is rocked forward by lifting upwardly on handle 208. In so doing undersurface 214 slips into engagement over corner 64 while at the same time inclined planar portion 216 is driven in wedge like fashion under edge 65 and between clamping surface 67 and the display piece. Finally, with the front portion 14 of the display piece gripped between inclined planar portion 216 and fulcrum portion 210, handle 208 may be rotated about pivot axis 18 until the poster display device is opened.

From the foregoing it will be appreciated that the present invention provides an attractive poster frame which allows for the display of readily replaceable posters or pictures, but which also resists tampering or unauthorized poster removal. The poster display device is rendered impossible to manually grasp and open by virtue of its smooth, and non convoluted non-reentrant contours. In addition, the spring bias forces provide ample resistance to prying as with fingernails, car keys, or the like. Moreover, the absence of any visible key operated locks and so forth coupled with the display device's attractive streamlined appearance renders it unlikely that a passerby would even consider trying to tamper with the display device. Indeed, by outward appearance it is not at all apparent that the poster display device is a front loading device, nor is there any outward indication of how front loading is effected.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A tamper-proof poster display device of the type having front and back portions adapted to be assembled in pivotal relationship to one another in defining a polygonal frame structure to receive a display piece, said portions being provided with coacting hinge formations in mating pivotal engagement with one another, and spring means extending between said front and back portions to bias the former with a snap-over action between a closed position in clamping engagement with the display piece and an open position to removably receive said piece, the improvement comprising said front portion having outwardly presenting first surface and laterally presenting second surface, said first and second surfaces smoothly and continuously converging to define an included dihedral angle greater than 90° and further comprising opener means removably engageable with said front portion for opening said display device.

2. The poster display device according to claim 1 wherein said first and second surfaces joint to form a non-convoluted contour.

3. The poster display device according to claim 1 wherein said first and second surfaces joint to form a non-reentrant contour.

4. The poster display device according to claim 1 further comprising laterally facing third surface smoothly and continuously converging with said first surface to define an included dihedral angle greater than 90°.

5. The poster display device according to claim 4 wherein said first and third surfaces join to form a non-convoluted contour.

6. The poster display device according to claim 4 wherein said first and third surfaces join to form a non-reentrant contour.

7. The poster display device according to claim 4 wherein said second and third surfaces lie generally in second and third planes, respectively, said second and third planes converging along a locus disposed outwardly of said first surface.

8. The poster display device according to claim 1 wherein said front portion defines a generally U-shaped means having rounded non-convoluted corners.

9. The poster display device according to claim 1 wherein said opener means includes inclined planar means for insertion between said front and back portions and fulcrum means engageable with said front portion.

10. A tamper-proof poster display device of the type having front and back portions adapted to be assembled in pivotal relationship to one another in defining a polygonyl frame structure to receive a display piece, said portions being provided with coacting hinge formations in mating pivotal engagement with one another to define an axis, and spring means extending between said front and back portions to bias the former with a snap-over action between a closed position in clamping engagement with the display piece and an open position to removably receive said piece, the improvement comprising:

said front portion having an outwardly presenting first surface, and a laterally presenting second surface converging with said first surface to define a first included dihedral angle greater than 90°;

said front portion having a laterally presenting third surface converging with said first surface to define a second included dihedral angle;

said second and third surfaces each defining a continuum of manually accessible points wherein with respect to each of said manually accessible points there exists a surface normal;

wherein said surface normal at any given one of said manually accessible points on one of said second or third surfaces defines an angle with respect to a line between said given manually accessible point and another manually accessible point on the other of said second and third surfaces;

wherein said angle defined between said surface normal and said line is greater than or equal to the trigonometric arctangent of the coefficient of friction attributable to said surfaces of said front portion; and wherein said second and third surfaces are arranged such that gripping forces applied during attempts to manually grip said front portion act in a direction tending to close said display device.

11. The poster display device according to claim 10 wherein said front portion defines a generally U-shaped means having rounded non-convoluted corners.

12. The poster display device according to claim 10 wherein the bias of said spring means contributes to said forces required to open said display device.

13. A tamper-proof poster display device of the type having front and back portions adapted to be assembled in pivotal relationship to one another in defining a polygonyl frame structure to receive a display piece, said portions being provided with coacting hinge formations in mating pivotal engagement with one another, and spring means extending between said front and back portions to bias the former with a snap-over action between a closed position in clamping engagement with the display piece and an open position to removably receive said piece, the improvement comprising said front portion having outwardly presently first surface and laterally presenting second and third surfaces joining said first surface in rounded non convuluted corners thereby defining a generally u-shaped means, the average plane of said second and third surfaces converging along a locus disposed outwardly of said first surface and further comprising opening means removably engageable with said front portion for opening said device.

14. The poster display device according to claim 13 wherein said first and second surfaces smoothly and continuously converge to define an included dihedral angle greater than 90°.

15. The poster display device according to claim 13 wherein said first and third surfaces smoothly and continuously converge to define an included dihedral angle greater than 90°.

16. The poster display device according to claim 13 wherein said first and second surfaces converge to define a non-reentrant contour.

17. The poster display device according to claim 13 wherein said first and third surfaces converge to define a non-reentrant contour.

18. The poster display device according to claim 13 wherein said opener means includes inclined planar means for insertion between said front and back portions and fulcrum means engageable with said front portion.

19. A tamper-proof poster display device of the type having front and back portions adapted to be assembled in pivotal relationship to one another in defining a polygonal frame structure to receive a display piece, said portions being provided with coacting hinge formations in mating pivotal engagement with one another, and spring means extending between said front and back portions to bias the former with a snap-over action between a closed position in clamping engagement with the display piece and an open position to removably receive said piece, the improvement comprising said front portion having outwardly presenting first surface and laterally presenting second and third surfaces joining said first surface in rounded non convoluted corners thereby defining a generally u-shaped means, and opener means engageable with said front portion to urge said display device toward said open position, said opener means comprising lever means having a handle, an inclined planar means carried by said lever means for insertion between said front portion and said display piece, and a fulcrum portion engageable with said u-shaped means.

20. The poster display device according to claim 19 wherein said front portion has a fourth surface joining said second surface for delivering clamping forces to said display piece and said inclined planar means is insertable between said fourth surface and said display piece.

21. The poster display device according to claim 19 wherein said first and second surfaces smoothly and continuously converge to define an included dihedral angle greater than 90°.

22. The poster display device according to claim 19 wherein said first and third surfaces smoothly and continuously converge to define an included dihedral angle greater than 90°.

23. The poster display device according to claim 19 wherein said first and second surfaces converge to define a non-reentrant contour.

24. The poster display device according to claim 19 wherein said first and third surfaces converge to define a non-reentrant contour.

25. The poster display device according to claim 19 wherein said handle is disposed at one end of said lever means and said fulcrum portion is disposed at the other end of said lever means.

26. The poster display device according to claim 25 wherein said opener means further comprises flange means disposed intermediate said lever means and said inclined planar means is carried on said flange means.

27. The poster display device according to claim 19 wherein said inclined planar means includes substantially flat undersurface for resting adjacent said display piece and inclined upper surface for wedging between said front portion and said display piece.

28. The poster display device according to claim 19 wherein said second surface includes edge means resting adjacent said display piece when display device is in closed position and said first and third surfaces define first corner means, wherein said inclined planar means includes chisel edge and wherein said fulcrum means includes undersurface means, said undersurface means and said chisel edge being disposed in spaced relation a distance less than the distance between said first corner means and said edge means.

29. A tamper-proof poster display device of the type having front and back portions adapted to be assembled in pivotal relationship to one another in defining a polygonyl frame structure to receive a display piece, said portions being provided with coacting hinge formations in mating pivotal engagement with one another, and spring means extending between said front and back portions to bias the former with a snap-over action between a closed position in clamping engagement with the display piece and an open position to removably receive said piece, the improvement comprising said front portion having an outwardly presenting first surface and laterally presenting second and third surfaces joining said first surface in rounded non-convuluted corners thereby defining a generally U-shaped means, the average plane of said second and third surfaces converging along a locus disposed outwardly of said first surface, said second and third surfaces being arranged such that gripping forces applied during attempts to manually grip said front portion act in a direction tending to close said display device, and the bias of the spring means adding to the forces required to open said display device.

* * * * *

UNITED STATES PATENT AND TRADEMARK OFFICE

CERTIFICATE OF CORRECTION

PATENT NO. : 4,519,152

DATED : May 28, 1985

INVENTOR(S) : James R. Seely, Robert Sarkisian

It is certified that error appears in the above-identified patent and that said Letters Patent is hereby corrected as shown below:

| | |
|---|---|
| Column 2, line 44 | "continously" should be --continuously-- |
| Column 3, line 25 | "end" should be --each-- |
| Column 3, line 62 | "’’" should be --‘‘-- |
| Column 4, line 47 | "gradually" should be --generally-- |
| Column 4, line 48 | "surfaces" (first occurrence) should be --surface-- |

Signed and Sealed this

*Thirty-first* Day of *December 1985*

[SEAL]

*Attest:*

DONALD J. QUIGG

*Attesting Officer*

*Commissioner of Patents and Trademarks*